US006651551B1

(12) United States Patent
Castellanos

(10) Patent No.: US 6,651,551 B1
(45) Date of Patent: Nov. 25, 2003

(54) PRINTABLE ABSORBENT SURFACE HAVING PERMANENT IMAGE AND DISAPPEARING IMAGE

(75) Inventor: Ricardo M. Castellanos, Stockton, CA (US)

(73) Assignee: Appear Gear, Inc., Roanoke, VA (US)

( * ) Notice: Subject to any disclaimer, the term of this patent is extended or adjusted under 35 U.S.C. 154(b) by 432 days.

(21) Appl. No.: 09/627,427

(22) Filed: Jul. 27, 2000

(51) Int. Cl.[7] ..... B41F 17/00

(52) U.S. Cl. ..... 101/35; 101/483; 101/487; 101/488; 101/491

(58) Field of Search ..... 101/35, 483, 487, 101/488, 491; 428/29

(56) References Cited

U.S. PATENT DOCUMENTS

| | | | | |
|---|---|---|---|---|
| 736,035 | A | 8/1903 | Stevenson | |
| 3,989,279 | A | 11/1976 | Levy | 283/8 |
| 4,028,118 | A | 6/1977 | Nakasuji et al. | 106/21 |
| 4,210,346 | A | 7/1980 | Mowry, Jr. et al. | 283/8 |
| 4,457,723 | A | 7/1984 | Tate | 434/409 |
| 4,510,188 | A | 4/1985 | Ruggeri | 428/1 |
| 4,528,239 | A | 7/1985 | Trokhan | 428/247 |
| 4,642,250 | A | 2/1987 | Spector | 428/1 |
| 4,659,619 | A | 4/1987 | Tate | 428/321.5 |
| 4,725,462 | A | 2/1988 | Kimura | 428/29 |
| 5,282,651 | A | 2/1994 | Alonso | 283/117 |
| 5,842,905 | A | 12/1998 | Lee et al. | 446/296 |
| 5,865,933 | A | 2/1999 | Morin et al. | 156/272.8 |

FOREIGN PATENT DOCUMENTS

| | | |
|---|---|---|
| DE | 27 51 179 | 5/1978 |
| EP | 0 523 888 | 1/1993 |
| EP | 0 600 307 | 6/1994 |

OTHER PUBLICATIONS

Patent Abstracts of Japan, vol. 1995, No. 04, May 31, 1995 & JP 07 000628 A (Atsupuru One:KK), Jan. 6, 1995.

*Primary Examiner*—Andrew H. Hirshfeld
*Assistant Examiner*—Minh Chau
(74) *Attorney, Agent, or Firm*—Kenyon & Kenyon

(57) ABSTRACT

A printable absorbent surface is disclosed. The printable absorbent surface includes a permanent image of colors having half tones. The surface also includes a disappearing image of disappearing inks. The disappearing image disappears from the surface during a heat application. The surface also includes a slurry mix having a color. The surface also includes an application mix having a portion of the slurry mix and a portion of clear base. The application mix is applied to the disappearing image and placed on the surface.

17 Claims, 5 Drawing Sheets

PRINTABLE ABSORBENT SURFACE HAVING PERMANENT IMAGE AND DISAPPEARING IMAGE

TECHNICAL FIELD

The present invention relates printable absorbent surfaces that have color and images. In particular, the present invention relates to a printable absorbent surface that has colors and images, wherein a color or image disappears from the surface when a heat application occurs.

BACKGROUND AND FEATURES OF THE INVENTION

Many of today's products have images, logos or other information on the surface of the products. Most of these images are applied to the products by screen printing, image transfer, or direct application. One of the purposes of images on the products is to draw attention to the product. In addition, the aesthetic value of the product may be enhanced by the image or color.

Attempts have been made to distinguish products from each other by manipulating the image or color on the product surface. For example, shirts and other apparel may change color or create a unique color pattern due to the temporary application of heat. Generally, the heat is body heat or sunlight. One might press a hand against a shirt and an outline of the hand changes color on the shirt. Other examples include bathing suits that might change color in the sun or after becoming wet.

None of these examples, however, provide an image changing surface, wherein an image may be altered or disappear as a result of applying heat to the surface. For example, a company logo may morph into another logo, the company name or slogan. This change process enhances the aesthetic value of the product as well as grabbing the attention of those who see it. Such actions may distinguish one's products from others in the sense that multiple images and information is being communicated to consumers. Thus, it is desirable to alter the images on a product in this fashion.

A known method for showing two images on a surface may be termed a "butt registration." But registration takes an image and separates it into two parts. One part is permanent to the surface, while the second part may appear when heat is applied to the surface. The two parts, however, may not be placed on top of each other. Generally, the second part is covered by a dark colored slurry mix. When heat is applied, or the surface comes in contract with skin, the colored slurry disappears and the covered image appears. Thus, the "whole" image may be seen by this process.

A problem with butt registration is that the covered image may be identifiable through the color cover. Further, the images on the surface are limited. The covered part should be part of the uncovered image, or the images may be confusing. The present invention is not so limited. Images used according to the present invention need not be cut into separate parts, but may be two different images. This feature enhances the effect of the image manipulation process.

Another known method is placing two images on the surface, one on top of the other. When heat is applied, one image may appear on top of the other. Such a image manipulation, again, may be confusing, and the images would have to be clearly separated. This process also requires careful separation of the images, or overlap will occur. Despite the use of slurry to enhance the image changing effect, the slurry cannot fully separate the images from each other. The present invention allows two images to be placed on the surface without dependency on each other, or careful separation of the images.

An embodiment of the present invention includes a method for making a printable absorbant surface. The method includes printing a permanent image on the surface. The method also includes applying an application mix comprising a portion of slurry mix and a portion of clear base to the a disappearing. The method also includes printing the disappearing image on the permanent image with the application mix. This process may be used to make a variety of products, including, but not limited to, apparel, cloth, ceramics, paper, plastic, textiles, and the like.

Another embodiment of the present invention includes the features of a printable absorbent surface having multiple images. The surface includes a permanent image of colors having halftones. The surface also includes a disappearing image of disappearing inks. The disappearing image disappears during a heat application. The surface also includes an application mix having a portion of the slurry mix and a portion of clear base. The application mix is applied to the images on the surface.

Another embodiment of the present invention includes the features of a method for changing images on a surface. The method includes placing the surface in a cold state. The surface includes two separate images. The method also includes applying a heat application to the surface. The method also includes breaking encapsulations in an application mix on the surface as the surface enters a hot state. The method also includes altering the images on the surface. When the heat application is removed, the encapsulations crystallize and the images return to their original state.

DETAILED DESCRIPTION

The present invention discloses a surface that changes images during the application of heat. The surface is prepared according to the present invention. The present invention allows at least two images to be placed on top of each, with one image disappearing or changing during a heat application. The present invention includes a permanent image having colors of half tones. The present invention also includes a disappearing image of disappearing inks. The disappearing image disappears during a heat application. The heat application may be an action such as placing the surface on the body or going into the sunlight. The present invention also includes an application mix comprising a portion of a slurry mix and a portion of clear base. The application mix is applied to the disappearing image.

Figure 1:
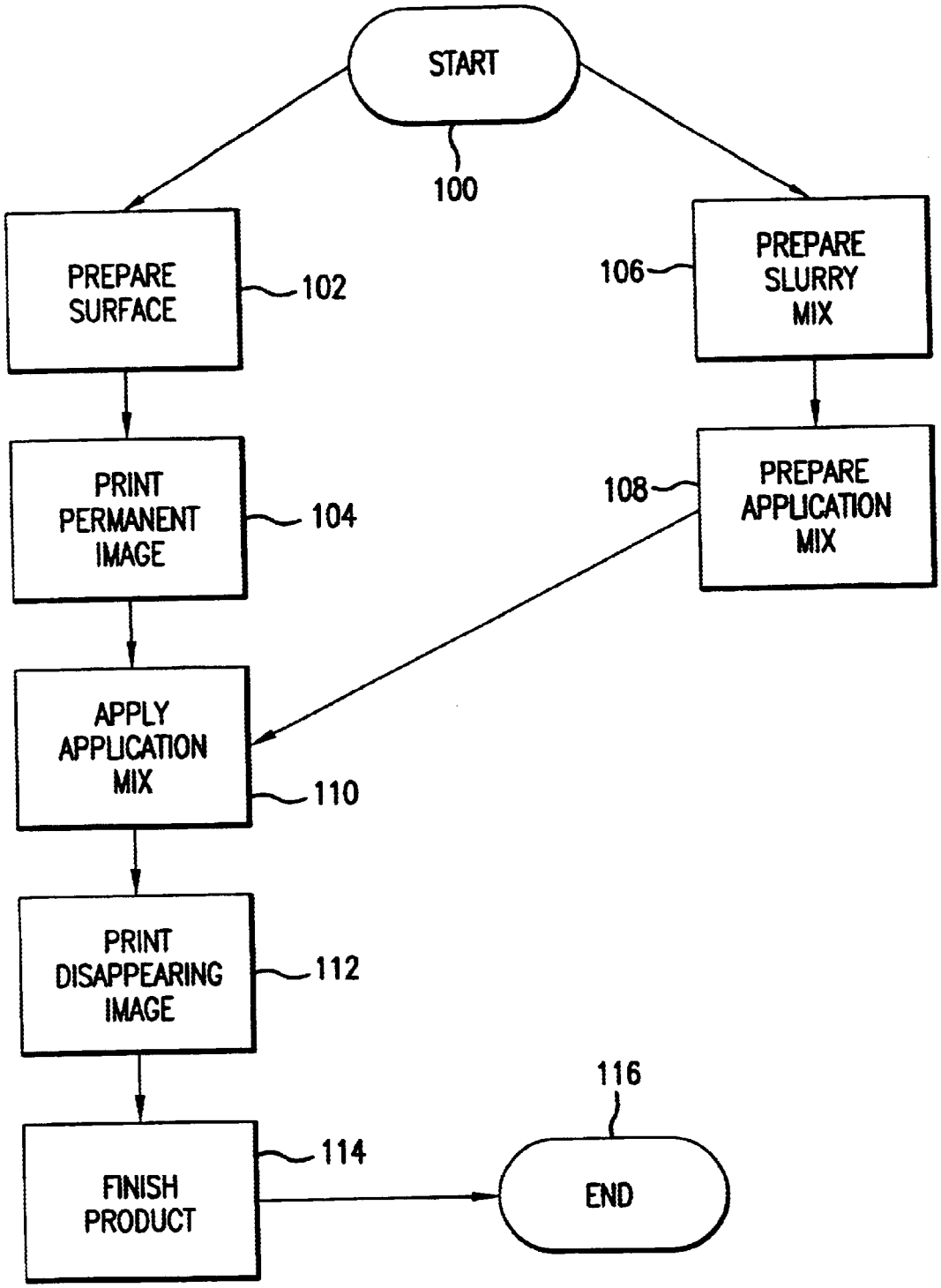
FIG. 1 shows a flowchart for making a printable absorbent surface having images.

FIG. 1 depicts a flowchart for making a printable absorbent surface having images in accordance with an embodiment of the present invention. Step 100 starts the process for making the surface. The printable absorbent surface may be any surface that can absorb inks to form images on the surface. Examples include cloth, apparel, ceramic, paper, plastic, and textile surfaces. Step 102 includes preparing the surface for the process in a known manner, such as cleaning the surface or making sure the surface is flat. Step 104 includes printing a permanent image on the surface. A permanent image is the image that will not disappear during the heat application. Preferably, the permanent image will be covered by other images or colors. The permanent image may be comprised of dots of a color placed on the surface by a screen process. The dots are printed in process colors, and the design of the image is done in half tones. Use of dots gives the permanent image its contrast. Process colors may be defined as colors that are not true. Preferably, process colors exhibit a watery aspect such that the permanent image does not contrast sharply with the surface. Opaque colors are not desirable for the process colors.

Figure 1A:
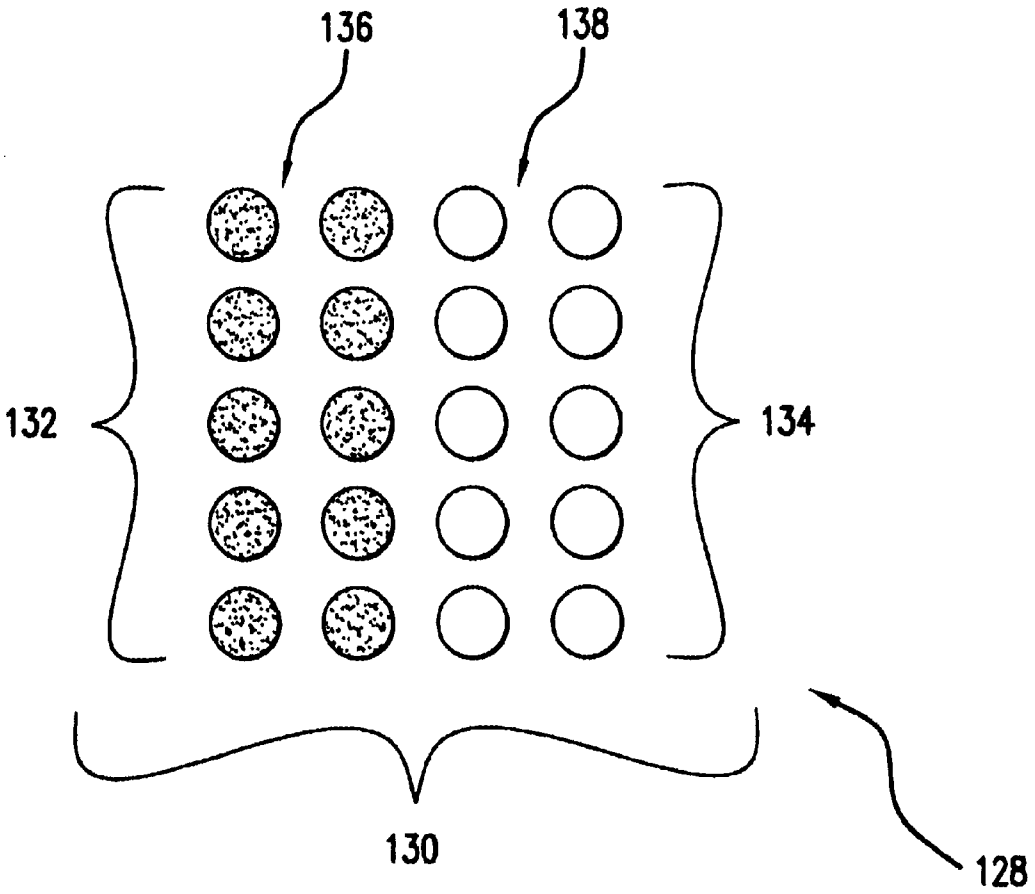
FIG. 1A shows a permanent image having dots.

Referring to FIG. 1A, a permanent image 130 having dots is depicted in accordance with an embodiment of the present invention. Permanent image 130 may be a graphical design, or, alternatively, just a color. Dots 132 and 134 are dots on the surface 128. As disclosed above, surface 128 is any surface that is printable and absorbent. Dots 132 and 134 are created by applying inks 136 and 138, respectively, to surface 128. Because dots 132 and 134 are in half tones, the amount of ink on the dots are reduced compared to typical applications. Preferably, the dots absorb a minimal amount of ink to form permanent image 130. Dots 132 preferably are different in color from dots 134, and ink 136 different in color from ink 138.

The screening process for printing permanent image 130 includes a screen having a high mesh grade. Preferably, the mesh grade is 160 to 230 count. The mesh grade may be defined as the number of mesh openings within a square inch or about 6.5 square centimeters, and refers to the tightness of the screen. Higher mesh grades result in better visual quality for permanent image 130.

Referring back to FIG. 1, step 104 is completed by printing the permanent image onto the surface. Step 106 includes preparing a slurry mix. The slurry mix is a color concentrate comprised of crystalized encapsulations. The slurry mix is water-based, and has not been mixed with any clear base or other dilution products. The slurry mix may be any color, and is not dependent upon the color of the permanent image. The crystalized encapsulations are temperature activated to break above a certain temperature. This state may be called the "hot state" because it occurs when heat is applied to the encapsulations. Preferably, the temperature is above 86 degrees Fahrenheit or about 30 degrees celsius. The hot state also may occur with the direct application of heat to the surface, such as a blow dryer. When the slurry mix cools off, or goes below 86 degrees, the encapsulations return to their crystallized form, or to their "cold state." Thus, the slurry mix promotes the impression that a color changes or disappears as the encapsulations move from a cold state to a hot state, or vice versa.

Step 108 includes preparing an application mix that will be placed on the surface with a disappearing image. The application mix comprises the slurry mix and a clear base that is mixed with the slurry mix. The clear base is an oil-based clear ink. Preferably, the clear base is Plastisol ™. Because the clear base is colorless, the application mix should be the same color as the slurry mix. Different slurry mixes, however, may be combined to produce different colors. For example, a yellow slurry mix may be combined with a red slurry mix and clear base to make an orange application mix in accordance an embodiment of the present invention.

Step 110 includes applying the application mix to a disappearing image that is to be placed on the surface. Preferably, the disappearing image is on a screen to be printed on the surface. Step 112 includes printing the disappearing image on the surface with the application mix. The disappearing image is comprised of disappearing inks. The disappearing image preferably differs in color from the permanent image. The disappearing image is printed according to regular screen methods, with film positives and regular art separation. The disappearing image should not be printed with half tones, but full color tones. A screen for the disappearing image should have a mesh count of 80 to 110. The application mix is placed on the screen having the disappearing image, and both are printed on the surface.

Step 114 includes any finishing steps that need to be taken with the surface to make the permanent image, disappearing image and application mix into a finished product. Step 116 ends the process for making a surface having images.

Figure 2:
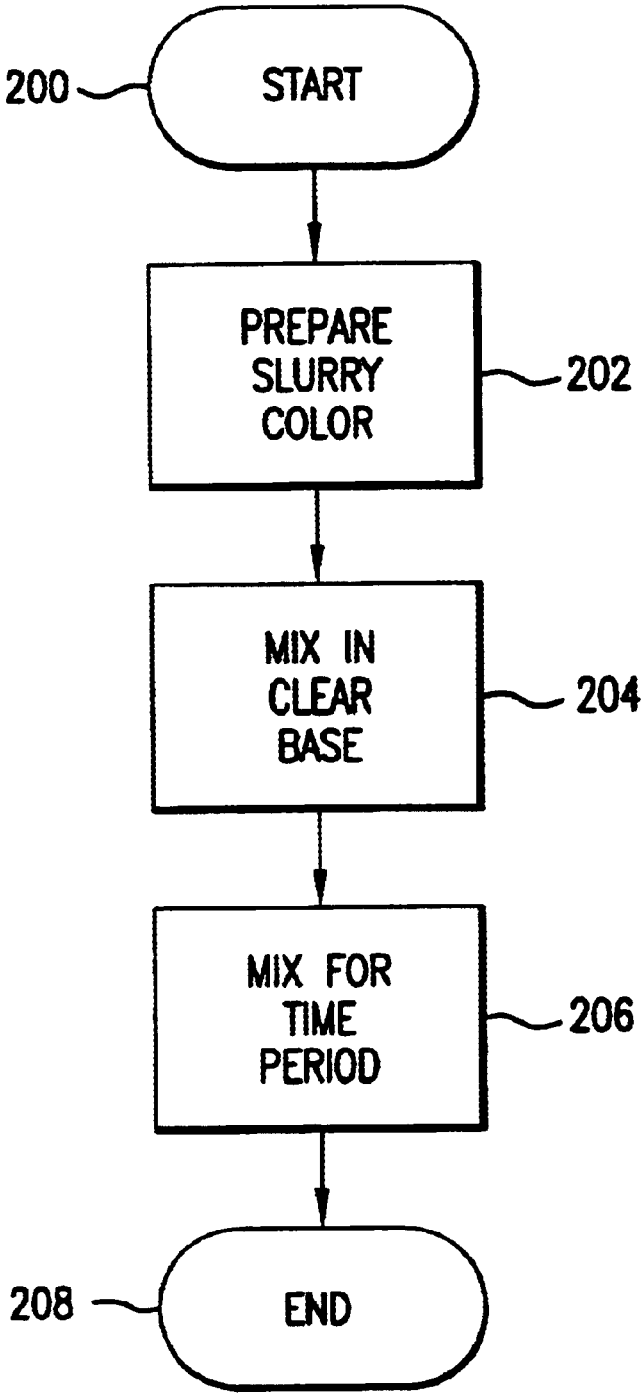
FIG. 2 shows a flowchart for making an application mix.

FIG. 2 depicts a flowchart for making an application mix in accordance with an embodiment of the present invention. Step 200 starts the process for making the application mix. Step 202 includes preparing the colored slurry. As disclosed above, the color slurry mix will provide the color that changes or disappears when heat is applied to the surface. Different colored slurry mixes may be provided to make a final color slurry mix, such as the red-yellow to orange example given above. The slurry mix is comprised of crystallized encapsulations in liquid form. Step 204 includes mixing in the clear base to the slurry mix to make the application mix. Thus, the application mix comprises a portion of slurry mix and a portion of clear base. The portions should be proportional to each other., Preferably, the application mix should be ¾ clear base and ¼ slurry mix. The exact measured amounts to be used in making the images on the surface may be calculated according to this ratio. The application mix is mixed vigorously. Step 206 includes mixing the application mix for a time period. Preferably, the time period is approximately two minutes. Step 208 ends the process. The resultant application mix may be used in the process disclosed in FIG. 1. This application mix provides the disappearing image with the color or background that changes or disappears when heat is applied. In addition, the application mix may cover the permanent image such that it is not visible when the surface is not heated, or the slurry encapsulations are crystallized.

Figure 3:
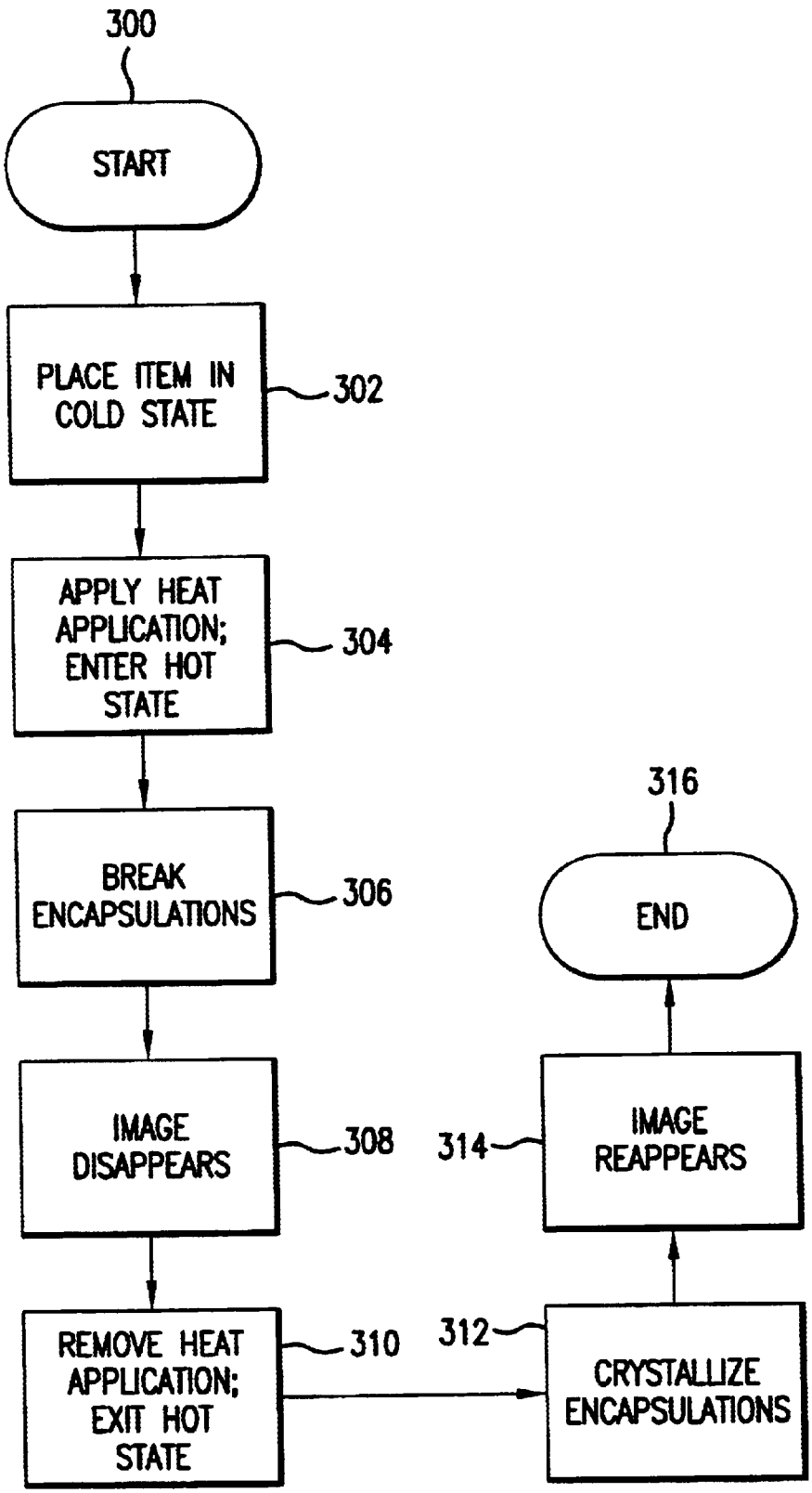
FIG. 3 shows a flowchart for changing an image on a printable absorbent surface.

FIG. 3 depicts a flowchart for changing images on a printable absorbent surface in accordance with an embodiment of the present invention. Step 300 starts the process for changing images. The images change by one image disappearing or being altered. Further, the image may just be a color that disappears or changes according to the process. Preferably, a disappearing image disappears or changes to reveal a permanent image on the surface.

Step 302 includes placing the item having the surface in a cold state. For example, the item could be a shirt and the printable absorbent surface could be cloth. The shirt is in a "cold state," which means the encapsulations of the slurry mix are crystallized to a certain slurry color. Preferably, the cold state of an item is below about 86 degrees Fahrenheit, or about 30 degrees celsius. This temperature is termed the activation temperature. The cold state, however, may be below any temperature, but should be related to body temperature. A few degrees below body temperature is preferable because an item worn on the body may not necessarily rise to the level of the body temperature. Thus, the images would change infrequently if strictly tied to body temperature. Other items may have a higher activation temperature, such as a coffee mug.

Step 304 includes applying a heat application and entering the hot state. A heat application may be any event that increases the temperature of the item. Heat can be applied to the shirt by putting it on one's body, or walking outside to hot weather. Another event is using an air dryer to blow hot air onto the surface to raise the temperature. The surface and item enter a "hot state" so that the encapsulations begin to break apart, which changes the slurry in the application mix. The slurry color may change or disappear as the surface enters the hot state. Preferably, the hot state is about 86 degrees Fahrenheit or above, or about 30 degrees celsius.

Step 306 includes the encapsulations breaking over a temperature range associated with the activation temperature. The encapsulations within the slurry mix begin to break down to release the color or disappearing agent within them to change the images on the surface. Thus, images can be manipulated without dividing the images, such as a but registration. Step 308 includes the disappearing image disappearing or changing as a result of the encapsulations breaking.

Step 310 includes removing the heat activation to cause the item and surface to leave the hot state. Thus, the encapsulations begin to re-enter the cold state, and re-crystallize. Step 312 includes the encapsulation crystalizing, and step 314 includes the disappearing image re-appearing on the surface so that the item appears as it did in step 302. Removing the heat application may include taking the item away from the body or heat event, or exposing the surface to a cold application. A cold application can be standing near an air conditioner or refrigerator. A cold application also means placing the item in water. For example, the shirt may revert back to the cold state when the wearer jumps into a pool. Step 316 ends the process.

Thus, according to the process disclosed above, a shirt having two different images may change from one to the other by applying heat to the surface of the shirt. For example, a user may place that shirt on when it is in the cold state. After the shirt is on the user's body, heat is applied to the shirt and the surface having the images. The encapsulations begin to break as the shirt near the activation temperature, or about 86 degrees Fahrenheit. The disappearing image begins to disappear or change as the slurry mix morphs from the cold to the hot state. The user walks outside into the sunlight, which further increases the temperature of the shirt and facilitates the slurry mix morphing completely. The permanent image is now visible after being non-visible before. The user then takes the shirt off and the encapsulations within the slurry mix return to the cold state. The disappearing image re-appears as the permanent image is concealed by the slurry color.

Figure 4A:
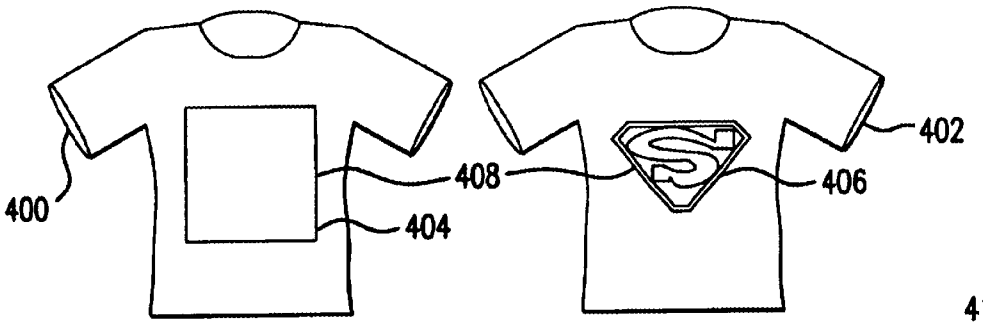
FIG. 4A shows a shirt with changing images.

FIGS. 4A–D depict items having surfaces that change images in accordance with embodiments of the present invention. The surfaces each have permanent and disappearing images. FIG. 4A depicts a shirt having images in accordance with an embodiment of the present invention. Shirt 400 is a shirt in a cold state. Preferably, shirt 400 is made of cotton cloth. Shirt 402 is shirt 400 in a hot state. Shirt 400 displays disappearing image 404, that is visually perceptible in the cold state. Shirt 402 displays permanent image 406, that is visually perceptible in the hot state. As shirt 400 becomes shirt 402, disappearing image 404 disappears to reveal permanent image 406. The encapsulations within application mix 408 break to alter the surface of shirt 400 and morph disappearing image 404 to permanent image 406. Application mix 408 is common to both cold and hot states, and is depicted on shirts 400 and 402.

Figure 4B:
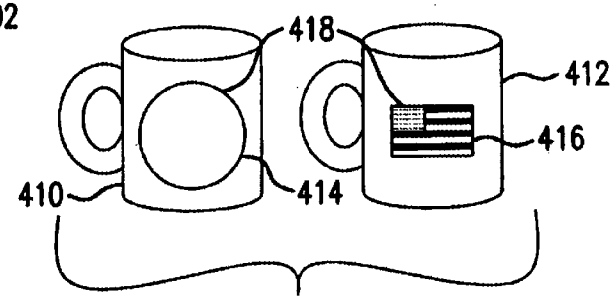
FIG. 4B shows a ceramic with changing images.

FIG. 4B depicts a mug having images in accordance with an embodiment of the present invention. Mug 410 is a mug in a cold state. Preferably, mug 410 is made of ceramic. Mug 412 is mug 410 in a hot state. Mug 410 displays disappearing image 414, that is visually perceptible in the cold state. Mug 412 displays permanent image 416, that is visually perceptible in the hot state. As mug 410 becomes mug 412, disappearing image 414 disappears to reveal permanent image 416. The encapsulations within application mix 418 break to alter the surface of mug 410 and morph disappearing image 414 to permanent image 416. Application mix 418 is common to both cold and hot states, and is depicted in mugs 410 and 412.

Figure 4C:
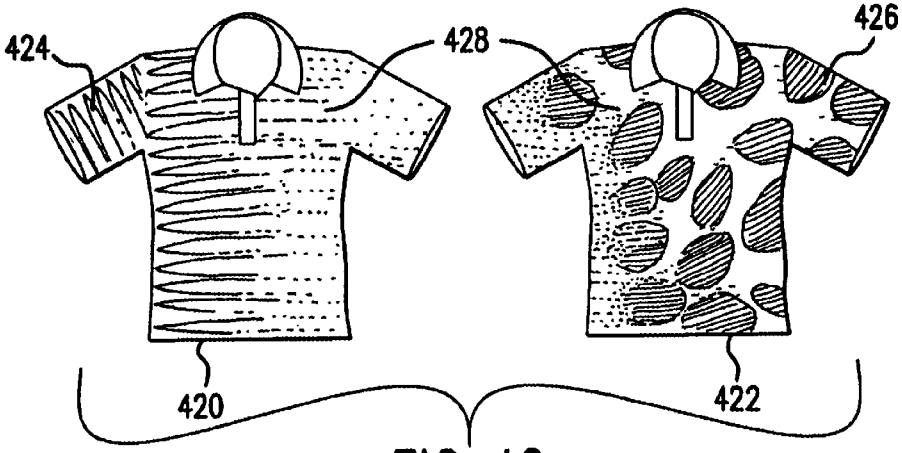
FIG. 4C shows apparel with changing images.

FIG. 4C depicts a piece of apparel in accordance with an embodiment of the present invention. Apparel 420 is a piece of apparel in a cold state. Preferably, apparel 420 is comprised of linen. Apparel 422 is apparel 420 in a hot state. Apparel 420 displays disappearing image 424, that is visually perceptible in the cold state. Apparel 422 displays permanent image 426, that is visually perceptible in the hot state. As apparel 420 becomes apparel 422, disappearing image 424 disappears to reveal permanent image 426. The encapsulations within application mix 428 break to alter the surface of apparel 420 and morph disappearing image 424 to permanent image 426. Application mix 428 is common to both cold and hot states, and is depicted on apparels 420 and 422.

Figure 4D:
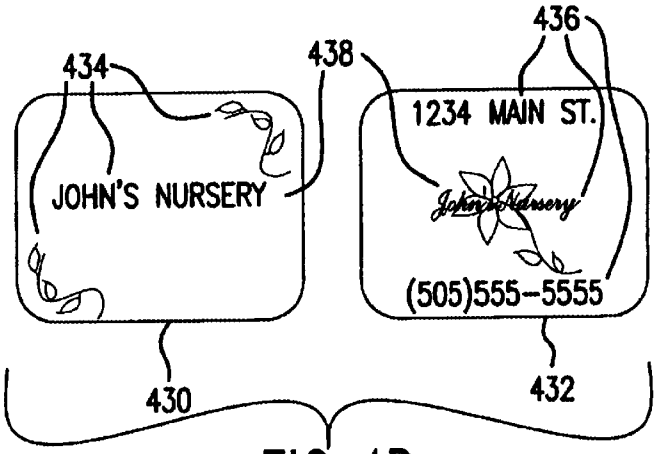
FIG. 4D shows paper with changing images.

FIG. 4D depicts a business card in accordance with an embodiment of the present invention. Card 430 is a card in a cold state. Preferably, card 430 is made of paper. Card 432 is card 430 in a hot state. Card 430 displays disappearing images 434, that are visually perceptible in the cold state. Card 432 displays permanent images 436, that are visually perceptible in the hot state. As card 430 becomes card 432, disappearing images 434 disappear to reveal permanent images 436. The encapsulations within application mix 438 break to alter the surface of card 430 and morph disappearing images 434 to permanent images 436. Application mix 438 is common to both cold and hot states, and is depicted on cards 430 and 432. Cards 430 and 432 depict multiple images on the surface, that change during a heat application.

Thus, it is apparent that there has been provided, in accordance with the embodiments of the present invention disclosed above, a printable absorbant surface having images that change during a heat application. Although the present invention has been disclosed in detail, it should be understood that various changes, substitutions, and alterations may be made herein. Other examples are readily ascertainable by one skilled in the art and may be made without departing from the spirit and scope of the present invention as defined by the following claims.

What is claimed is:

1. A printable absorbent surface having images, comprising:

a permanent image of colors having half tones, printed using a screen with a mesh from about 160 count to about 230 count;

a disappearing image of disappearing inks, said disappearing image disappears during a heat application;

a slurry mix having a color; and an application mix having a portion of said slurry mix and a portion of clear base comprising oil-based clear ink, the application mix being about ¾ clear base and ¼ slurry mix, said application mix applied to print said disappearing image using a screen with a mesh from about 80 count to about 110 count.

2. The surface of claim 1, wherein said permanent image comprises ink dots.

3. The surface of claim 1, wherein said disappearing image comprises film positives and regular art separations.

4. The surface of claim 1, wherein said slurry mix is water-based.

5. The surface of claim 1, wherein said slurry mix includes crystalized encapsulations.

6. The surface of claim 5, wherein said crystalized encapsulations are temperature activated during said heat application.

7. The surface of claim 1, wherein said application mix includes at least one color.

8. A method for making a printable absorbent surface having images, comprising:

printing a permanent image on said surface in half tones using a screen having a mesh grade of about 160 count to about 230 count;

preparing an application mix comprising a portion of slurry mix and a portion of clear base comprising an oil-based clear ink, the application mix being about ¾ clear base and ¼ slurry mix; and printing a disappearing image on said permanent image with said application mix using a screen having a mesh grade of about 80 count to about 110 count.

9. The method of claim 8, wherein said preparing step includes mixing said slurry mix and said clear base.

10. The method of claim 9, wherein said mixing step includes mixing for a time period.

11. The method of claim 10, wherein said time period is approximately two minutes.

12. The method of claim 8, wherein said first printing step includes applying ink dots to said surface.

13. The method of claim 8, further including preparing said slurry mix.

14. The method of claim 13, wherein said preparing step includes adding another slurry mix to said slurry mix, said another slurry mix having a different color than said slurry mix.

15. A method for making a printable absorbent surface having images, said images changing during a heat application, comprising:

printing a permanent image on said surface by applying half tone ink dots using a screen with a mesh from about 160 count to about 230 count;

preparing a slurry mix having a color, said slurry mix comprising encapsulations;

mixing an application mix comprising a portion of said slurry mix and a portion of clear base comprising an oil-based clear ink, the application mix being about ¾ clear base and ¼ slurry mix;

applying said application mix to a disappearing image; and printing said disappearing image on said permanent image with said application mix such that said encapsulations reside on said surface.

16. The method of claim 15, wherein said preparing step includes adding another slurry mix to said slurry mix, said another slurry mix having a different color from said color of said slurry mix.

17. An article of manufacture having a printable absorbent surface, made by the process comprising:

printing a permanent image on said surface by applying half tone ink dots using a screen with a mesh from about 160 count to about 230 count;

preparing a slurry mix having a color, said slurry mix comprising encapsulations;

mixing an application mix comprising a portion of said slurry mix and a portion of clear base comprising an oil-based clear ink, the application mix being about ¾ clear base and ¼ slurry mix;

applying said application mix to a disappearing image; and printing said disappearing image on said permanent image with said application mix such that said encapsulations reside on said surface.

* * * * *